United States Patent [19]

New

[11] Patent Number: 4,695,192

[45] Date of Patent: Sep. 22, 1987

[54] FLAPPER-TYPE SEALING SYSTEM FOR A REMOVABLE BOTTOM FOUNDED STRUCTURE

[75] Inventor: Richard New, Kenmore, N.Y.

[73] Assignee: Chevron Research Company, San Francisco, Calif.

[21] Appl. No.: 835,420

[22] Filed: Mar. 3, 1986

[51] Int. Cl.[4] ..... E02B 17/00; E02D 23/16

[52] U.S. Cl. ..... 405/203; 405/195; 405/224

[58] Field of Search ..... 405/195, 203, 204, 207, 405/208, 224; 114/296

[56] References Cited

U.S. PATENT DOCUMENTS

| | | | |
|---|---|---|---|
| 2,530,160 | 11/1950 | Finley . | |
| 2,657,661 | 11/1953 | Robson | 114/201 |
| 2,686,343 | 1/1951 | Harpoothian et al. . | |
| 2,720,011 | 5/1951 | Krupp . | |
| 2,937,006 | 5/1960 | Thayer | 255/2.5 |
| 3,348,517 | 10/1967 | Johnson et al. | 114/296 |
| 3,494,136 | 2/1970 | Wilms . | |
| 3,520,543 | 7/1970 | Etter et al. | 114/296 X |
| 3,701,500 | 10/1972 | Zeffer et al. | 244/103 R |
| 3,892,287 | 7/1975 | Bennett | 180/115 |
| 3,896,628 | 7/1975 | Hansen . | |
| 3,961,490 | 6/1976 | Corgnet . | |
| 4,155,671 | 5/1979 | Vos | 405/203 |
| 4,425,055 | 1/1984 | Tiedemann | 405/217 |
| 4,521,133 | 6/1985 | Suzuki et al. | 405/195 |
| 4,522,532 | 6/1985 | Fedrick | 405/195 X |
| 4,576,518 | 3/1986 | Cooke et al. | 405/203 X |

FOREIGN PATENT DOCUMENTS

| | | | |
|---|---|---|---|
| 2247377 | 5/1975 | France | 114/296 |

OTHER PUBLICATIONS

G. Sebastiani et al, "Offshore Drilling and Production Platforms with Rapid Removal and Redeployment . . . ", pp. 631–642.

*Primary Examiner*—Dennis L. Taylor
*Attorney, Agent, or Firm*—E. J. Keeling; P. L. McGarrigle; V. A. Norviel

[57] ABSTRACT

The Removable Bottom Founded Structure (RBFS) is an offshore platform for petroleum drilling and producing operations intended for deployment in waters with severe weather and iceberg conditions. The structure is normally held down by gravity, but during the deballasting procedure a hold-down system is employed to keep the platform on the subbase until site evacuation. The system that is used to hold the platform down onto the subbase is located where the platform meets the subbase. It operates on the principle of hydrostatics. On the underside of the columns there are multiple chambers which may be evacuated by pumping and which are vented to the outside atmosphere. Flexible seals that define these chambers are positively engaged by this evacuation to create a fluid-tight seal so that no seawater will enter the evacuated chambers. The reduction of the buoyancy forces in the chambers will hold the platform onto the subbase until such time as the platform is totally deballasted. Once that has occurred, the hydrostatic hold-down system is disengaged and the platform will quickly rise to the surface.

7 Claims, 4 Drawing Figures

$P_1 = \delta \cdot h_1 \cdot A$

SIMULATED NORMAL OPERATION
HOLDDOWN SYSTEM NOT ACTIVATED $P_2 = \delta \cdot h_2 \cdot A$

SIMULATED LIFT-OFF PROCEDURE
HOLDDOWN SYSTEM ACTIVATED $\delta$ = DENSITY OF $H_2O$
$h_1, h_2$ = HEIGHT OF $H_2O$ IN A TUBE
A = AREA OF BOTTOM OF COLUMN

FLAPPER-TYPE SEALING SYSTEM FOR A REMOVABLE BOTTOM FOUNDED STRUCTURE

CROSS REFERENCE TO RELATED APPLICATIONS

This application is related to applications having the problem numbers Ser. Nos. 835,419, 866,825, 839,492, 869,525, 869,524, 898,989, all assigned to the assignee of this application.

FIELD OF THE INVENTION

This invention generally relates to offshore oil drilling and producing structures. More specifically, to a sealing/hold-down system that is used on a structure for removably detaching that structure from a base located on the sea floor.

BACKGROUND OF THE INVENTION

As oil exploration continues in remote locations, the use of offshore drilling techniques and structures will become more commonplace in ice-infested areas. Platforms are continually erected in isolated areas that have extremely severe weather conditions. However, the structures that operate in more temperate climates cannot usually be employed here because they must be able to cope, not only with severe arctic storms and sea ice incursions, but also with large and small icebergs that are driven by wind, current and wave action. Because of these conditions, many different types of platform designs have arisen in an attempt to cope with the harsh weather and other natural elements.

Currently, much exploration is being conducted in the arctic and in the ice-infested waters off Alaska, Canada, and Greenland. To cope with the iceberg and weather problem, some structures attempt to resist these large ice masses by simply being large enough to withstand the crushing forces. Examples of these designs may be seen in dual cone structures, such as U.S. Pat. No. 4,245,929, large reef-like structures, or many other gravity based large concrete-steel configurations, see also U.S. Pat. No. 4,504,172. However, the problem with these structures is that they are either too heavy, expensive, or are permanently affixed to the bottom. As such, they do not lend themselves to either reuse or quick site evacuation in the case of an emergency situation.

Another design is that of a tension-leg platform (TLP) with disengageable or extensible legs as described in U.S. Pat. Nos. 3,955,521 and 4,423,985. These too have their inadequacies. The TLP floats by its own buoyancy, which means that it cannot take a substantial deck load. Furthermore, there may be problems with icebergs that have drafts large enough to scour the sea floor. Most TLP structures have exposed wellheads and anchoring systems and thus would incur substantial damage if an iceberg of this size came along. Additionally, since the platform is naturally buoyant, the tendons are under constant tension which generally shortens the life of the tie down system.

Another factor to be considered is cost. Generally, the type of large gravity-based structure that may be used for arctic exploration and production is very expensive and time consuming to build. With the unproven nature of some of the oil prospects, the harshness of the environment, the increased costs due to the weather down time, the probability of failure, and even the political climate, it becomes even more risky for an oil company to invest a large amount of money or time. In the event of an accident or other type of misadventure, losses could be greatly multiplied.

To overcome many of the disadvantages of these previously discussed arctic structures, it would be advantageous to combine some of the principles of the gravity-based structures with those of the floating structures. This is accomplished by constructing a platform that has subsurface hull chambers that may alternatively provide buoyancy or ballast and a subbase upon which the platform may rest. This structure may be floated to a drilling or production site and slowly filled with ballast until it rests on the sea floor. When a situation, threatening to the structure, presents itself, the platform may be deballasted and removed from the site to leave the subbase behind. However, this deballasting procedure is quite slow (on the order of 6 to 7 hours) and since it is probably going to be done in rough seas, there is a large chance that the structure may be damaged when it "bounces around" as it approaches neutral buoyancy, but before it reaches its floating draft.

A solution to this problem is to keep the platform down on the subbase with a hold-down means while it is being deballasted. Once it has fully deballasted, the hold-down means may then be released to allow the platform to quickly ascend to its floating draft and escape damage.

This hold-down system may be mechanical or hydraulic. However, because a mechanical system: may not assure a simultaneous release of all mechanical systems; is expensive; and difficult to reuse, a hydrostatic sealing system is chosen. This hydrostatic system will hold the structure to the base from the beginning of the deballasting procedure to the time when deballasting is complete. When this occurs, the structure may be quickly detached by releasing the seal and then floated away from the impending danger.

To eliminate most of the problems of these previously-mentioned arctic structures for use in ice-infested waters, the Removable Bottom Founded Structure (RBFS) was developed to provide a platform which may be removably detached from its base with the help of the aforementioned seals and, if necessary, transported to a safer location.

SUMMARY OF THE INVENTION

The present invention holds a buoyant platform onto a subbase that rests on the sea floor. The platform is called a Removable Bottom Founded Structure (RBFS) and it is designed for the arctic environment. The RBFS resembles a very large submersible drilling platform which, by virtue of its direct access to the wells, functions in many ways like a conventional fixed drilling and production platform. Normally the platform would be fully ballasted on the subbase with a combination of water and solid ballast. However, in the event of an approaching iceberg larger than one which the RBFS is designed to resist the sealing system is engaged, the platform is deballasted to a positive buoyancy condition, the risers are disconnected from the subbase, then the sealing system is released, and the platform floats, and propels itself off location to leave the subbase behind. In this design environment, the platform must disconnect from the subbase and reach its floating draft very quickly to avoid potential collision between the platform and the subbase. Here, the hold-down system keeps the platform down on the subbase, the platform is deballasted to achieve a large net buoyant upward force, and the hold-down mechanism is quickly released to lift off the platform.

To provide an appropriate hold-down mechanism, a system of redundant, elastomeric, flapper-type seals are arranged on the underside of the platform in a concentric arrangement. Once the seals are engaged, the hydrostatic head underneath the column is reduced by evacuating the ambient water. The platform stays in place during this time by effectively removing the buoyancy forces from the underside of the columns; thus, the platform alone holds itself down as if it were not resting on water. This keeps the platform on location until the difference in hydrostatic head between the area underneath the column and the outside environment is destroyed.

DETAILED DESCRIPTION OF THE INVENTION

The Removable Bottom Founded Structure (RBFS) is an offshore structure for petroleum drilling and producing operations and is intended for deployment in waters with severe weather and iceberg conditions. The RBFS is a two-part structure. The first part generally comprises a platform and is made up of multiple columns which are affixed to the deck structure. The second component is a reinforced concrete subbase that rests on the sea floor and upon which platform is founded.

The RBFS is designed to withstand severe conditions of wind, wave and current action, and many of those ice conditions which could normally be expected during the structure's life. For example, the RBFS was designed to withstand a 150 year return period storm; an iceberg with a 20 year return period kinetic energy; and to survive and sustain (with some damage) an impact with an iceberg having a 100-year return period kinetic energy. However, if an iceberg large enough to cause damage to the RBFS threatens to come in contact with the structure, the platform is evacuated from the site, to leave the subbase behind. To ensure that the inhabitants and operators of the RBFS are apprized of all iceberg and storm dangers, they maintain visual lookouts for good days and shorter distances, whereas may they use a satellite or radar system for longer distances and less clear weather. Danger zones, having specified radii, may also be established to allow the platform personnel to gauge the possibility of actual iceberg incursion.

Figure 1:
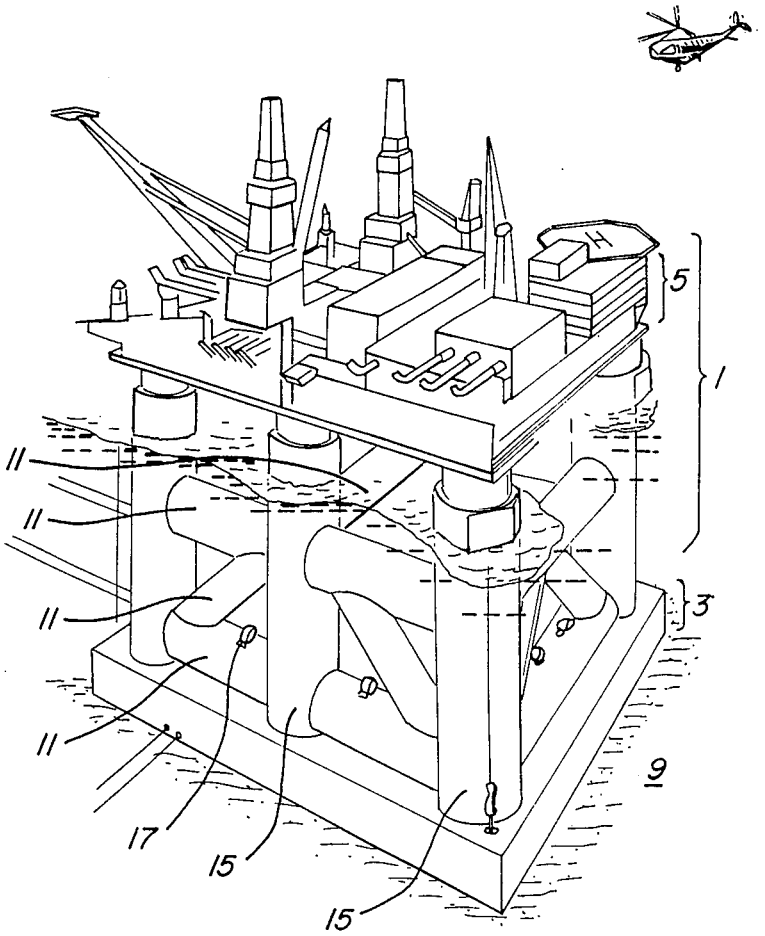
FIG. 1 is a view of the assembled platform resting on the subbase.

FIG. 1 shows that the RBFS comprises two portions, a platform 1 and a subbase 3. The platform 1 is comprised of a deck 5, braces 11, and columns 15. The subbase 3 is affixed to the sea floor 9 and provides a surface to receive axial and lateral loads from the platform 1.

The subbase 3 is a permanent reinforced concrete structure. It is shown in FIG. 1. The subbase 3 is designed to withstand a 100-year iceberg impact with practically no movement and no structural damage and is able to survive a 2000-year iceberg (while protecting a subsea well template) with limited damage. The subbase 3 provides a bearing surface for vertical and lateral load transfer from the platform 1 and protects the well template from iceberg scour.

To prevent potential collision between the platform 1 and the subbase 3 during an iceberg avoidance operation, the platform 1 must rise quickly to its floating draft, otherwise the platform 1 may come in contact with the subbase 3. Furthermore, to shorten the overall iceberg avoidance procedure, the platform 1 must be deballasted concurrently with other iceberg avoidance operations such as shutting in wells and purging and disconnecting the risers. To hold the platform 1 onto the subbase 3 while deballasting (and becoming more buoyant) the hydrostatic pressure that acts on the platform 1 must be reduced. To accomplish this, a system of seals enclose the perimeter of the base of each corner column 15. After a hold-down chamber 51, that is defined by: this system of seals; the column 15; and the subbase 3; is shut off from the outside seawater, it is evacuated by pumping. This reduces the hydrostatic pressure acting on the bottom of the column 15 and will effectively hold the platform 1 on the subbase 3.

Figure 4:
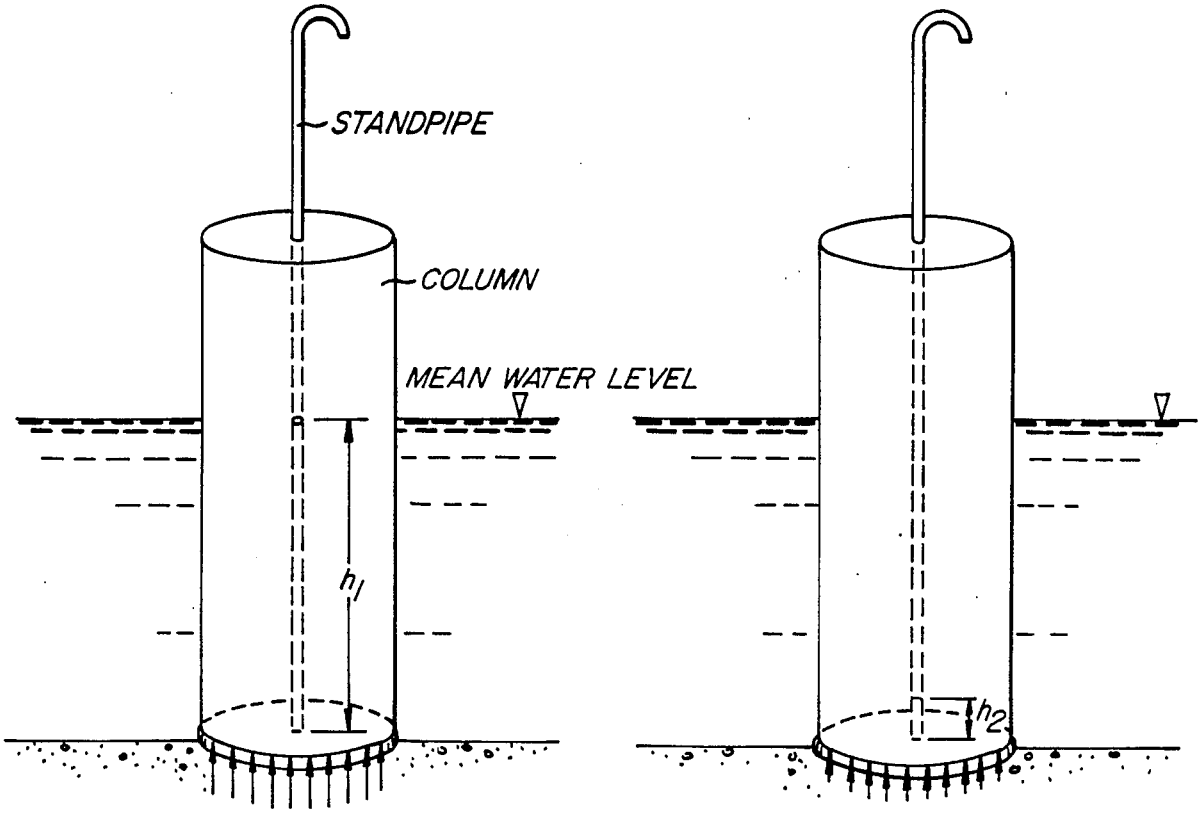
FIG. 4 represents the forces that act on the underside of a buoyant column.

The hydrostatic hold-down system operates by reducing the hydrostatic head on the area underneath the column 15. FIG. 4 represents the buoyancy forces acting on a column 15 before and after the sealing system is engaged. In normal states, the buoyant force that acts on a column 15 may be shown by $P_1 = \delta \cdot h_1 \cdot A$ where $P_1$ is the total buoyant force, $\delta$ is the density of water, $h_1$ is the height of water in the standpipe, and A is the area underneath the column 15. However, operation of the hold-down system reduces the water level in the standpipe to $h_2$. This decreases the buoyant force to a new value which can be expressed as $P_2 = \delta \cdot h_2 \cdot A$. The difference in hydrostatic pressure between the outside environment and the area underneath the column is maintained by the seals around the perimeter of the column which keeps the platform 1 on location.

Figure 2:
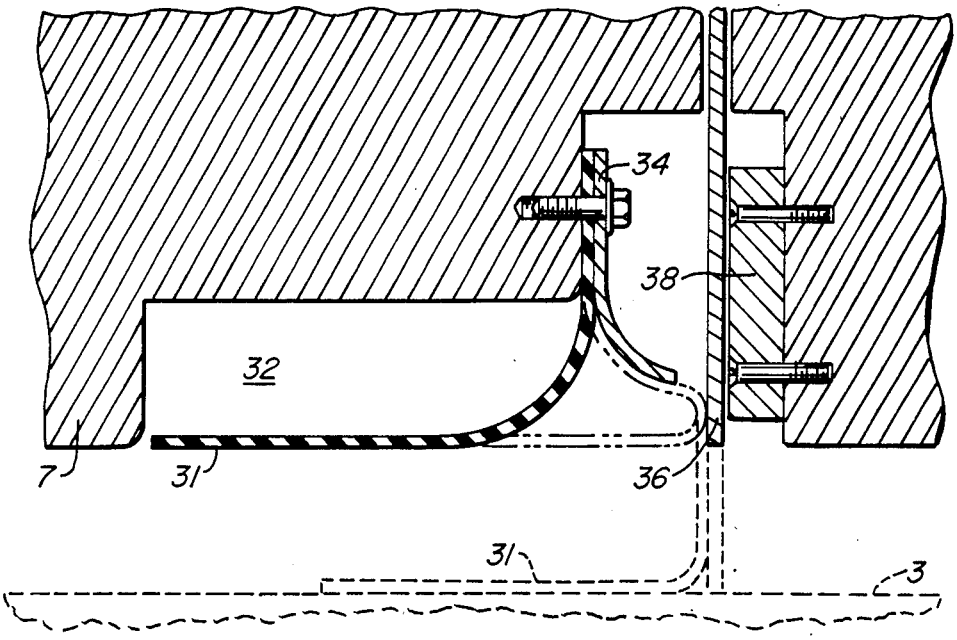
FIG. 2 is an enlarged view of a single sealing system.

FIG. 2 illustrates the flapper-type seal 31. The seal 31 is made of a steel or fabric reinforced rubber skirt. It sits in a recessed chamber 32 in the column 15 and is approximately 90° to the horizontal. A metallic backing plate 34 and a steel retaining ring 36 are placed behind the seal 31.

The steel sealing ring 36 is concentrically placed between the seal 31 and the hold-down chamber 51 and is partially supported by backup blocks 30. The sealing ring 36 is used to retain the seal 31 (in the positions shown in FIG. 2) during the evacuation of the hold-down chamber 51. Otherwise, the seal may be "sucked" into the hold-down chamber 51. The ring 36 is made of segments and is allowed to move vertically to accommodate the necessary tolerances for its seating on the subbase 3. The sealing ring 36 has a four-inch vertical movement and may be pinable in a full up position (for installation of blocks 38) (See FIG. 2). The full up position is necessary during the installation of the seal 31 for proper working clearance. A positive flow of water may be pumped into the hold-down chamber 51 and out past the seal to guarantee a proper attitude of the seal 31 while the platform 1 is sited onto the subbase 3.

During normal platform operation the RBFS behaves as a gravity structure. Because a hold-down force is not needed, the chamber 51 is open to the ambient hydrostatic pressure. As the platform 1 is deballasted and becomes more buoyant, the hydrostatic pressure in the chamber 51 is reduced by withdrawing water from the chamber 51 to create a hold-down force. The holddown force equals the product of the plan area of the chamber 51 and the differential pressure in the chamber 51, which is $\Delta P = \delta(h_1 - h_2)$ (the differential pressure is the ambient hydrostatic pressure at the top of the subbase 3 less the pressure in the chamber 51 which corresponds to the water level in the chamber 51). The sum of the hold-down forces in each chamber 51 would be sufficient to prevent uplifting of the platform 1 under the combined effects of the buoyancy of the deballasted platform 1 and the design storm loads. The hold-down force could be deactivated by opening the chamber 51 to the ambient hydrostatic pressure.

During the evacuation procedure, a pump means is used to reduce the hydrostatic head in the hold-down chamber 51. The resultant pressure differential between the chamber 51 and the outside environment forces the flexible elastomeric seal 31 into the steel retaining ring 36. The external pressure acting on the seal 31 would also place the seal 31 in contact with the subbase 3 to provide an essentially fluid-tight barrier.

Figure 3:
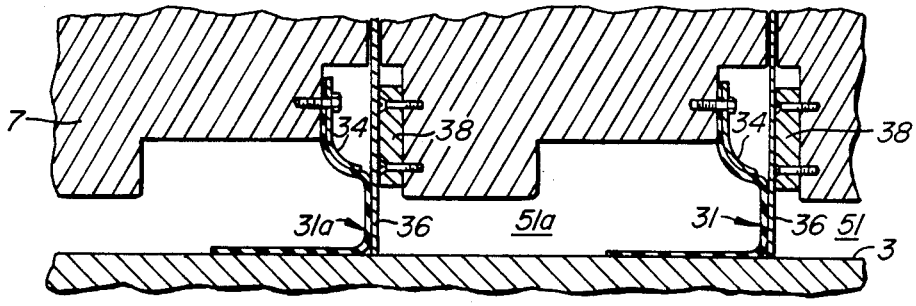
FIG. 3 is a cross-sectional view of the redundant hold-down sealing system as deployed.

A redundant system of seals may be employed to ensure proper sealing between the platform 1 and the subbase 3 (See FIG. 3). An identical outer seal 31*a* may be arranged in a concentric relationship exterior to the seal 31 described above. As a result of the placement of the two seals, a smaller, outer sealing chamber 51*a* will be formed. For proper evacuation of each sealing chamber 51 and 51*a* a sump (not shown) would be required in both the inner 51 and the outer chambers 51*a*.

Operation of the hydrostatic hold-down system is not necessary for the RBFS during normal operating conditions (because it is normally held in place by gravity). However, the seals would be frequently tested for leaks. Prior to deballasting, the hold-down chamber 51 is evacuated to engage the seals 31 and 31*a* and the platform 1 is deballasted by pumping out the ballast chambers. The pumps are sized such that the entire platform 1 can be deballasted in five hours. Redundant control of ballast tanks from several independent pumps is designed into the system, and ballast control is fully automated with manual backup.

If the seals are effective, then essentially all the water in the hold-down chamber 51 is removed. A float valve (not shown) may be used to turn off an evacuation pump when the water is gone and may reactivate the evacuation pump in the event of water leakage into the chamber 51. While the platform 1 is being fully deballasted and the area defined by the seals 31 and 31*a* has been evacuated, the various mechanical systems are prepared for liftoff.

Since the RBFS is intended to evacuate the site on impending impact of a large iceberg, all piping and control lines between the platform 1 and subbase 3 are readily disconnectably. (None of the following material is illustrated.) Therefore, the next step before site evacuation is to hydraulically disengage the riser mechanical latching system to lift the entire integrated riser bundle upward into the column 15 by means of hydraulic hoists. The production and injection wells and oil sales lines are shut in subsea and all lines in the integrated riser are purged with seawater. This is the final preparatory step in the liftoff procedure.

The platform 1 lifts off the subbase 8 when the platform operator destroys the difference in the hydrostatic pressure between the space 51 and the outside seawater. To equilibrate the pressure in the space (to that of the seawater) additional pressure may be used from such things as pumps, etc., but an easier way to destroy the pressure differential would be to allow water at that depth to flow into the space 51 from the outside. Once that is done the pressure on both sides of the seal 31 equalizes and the natural buoyancy of the platform 1 causes it to rise. Immediately after the platform 1 lifts off the subbase 3, it moves away under positive navigational control by a thruster system (see FIG. 1). The thruster system is designed to steer the platform 1 in a controlled manner, but not to station keep in severe storm states. Tugs in the vicinity (for iceberg towing, surveillance and other purposes) may provide further steering control once sea conditions permit attachment of towing lines.

When sea and ice conditions again permit, the platform 1 is resited on subbase 3 and platform 1 is reballasted. The integrated riser bundle (this system is not shown) is stabbed into its receptacle in subbase 3, hydraulic hoists are used to stab a riser connector down onto a connector mandrel, and integrated riser is reconnected to the wellhead. Drilling risers (also not shown) are also reattached to well template through a moonpool and the normal operations are again resumed.

Since many modifications and variations of the present invention are possible within the spirit of this disclosure, it is intended that the embodiments disclosed are only illustrative and not restrictive. For that reason, reference is made to the following claims rather than to the specific description to indicate the scope of this invention.

What is claimed is:

1. A sealing apparatus to affix a gravity founded, movable offshore structure onto a subbase that rests on the sea floor, during the time when the movable structure is being deballasted to prepare for rapid site removal, comprising:

a movable offshore platform;

at least one load bearing member to support the platform, the member is fixedly connected to the platform, and extends in a generally downward direction;

a generally flat surface on the underside of the member;

a subbase located on the sea floor to provide support to the platform;

a generally flat upper surface on the subbase to support the member on the upper surface of the subbase;

means for creating a space between the subbase and the member;

a reinforced, elastomeric flapper-type seal fixed in a closed loop on the bottom surface of the at least one member for sealing purposes, the seal being engaged once a portion of the platform weight forces the elastomeric seal down onto the subbase to establish a barrier around the space the seal mounted at approximately 90° relative to the surface of the subbase on a metallic backing plate and kept in position during evacuation by a retaining ring placed between the seal and the evacuated space;

means for evacuating the space between the subbase, the member, and the seal to reduce the hydrostatic pressure in the space to a lower pressure than the surrounding seawater, so that when the space has been evacuated, the platform will be held onto the subbase until the hydrostatic pressure in the evacuated space has been restored to equilibrium with the outside sea environment.

2. The sealing apparatus as recited in claim 1 wherein there is a secondary seal concentrically spaced inside the primary seal.

3. The sealing apparatus as recited in claim 2 wherein the primary and secondary seals are mounted in a recessed compartment in the underside of the member.

4. The sealing apparatus as recited in claim 1 wherein the seal ring may be pinable in a full up position.

5. The sealing apparatus as recited in claim 1 wherein the support member is a column.

6. The sealing apparatus as recited in claim 1 where the support member includes a pontoon affixed to the bottom of at least one column.

7. The sealing apparatus as recited in claim 1 having hydraulic pressure means used to guarantee the proper attitude of the seal when it contacts the subbase.

* * * * *